US007649530B2

(12) United States Patent
Takeda

(10) Patent No.: US 7,649,530 B2
(45) Date of Patent: Jan. 19, 2010

(54) MODE-SELECTING APPARATUS, DISPLAY APPARATUS INCLUDING THE SAME, AND METHOD OF SELECTING A MODE IN DISPLAY UNIT

(75) Inventor: Hiroshi Takeda, Kanagawa (JP)

(73) Assignee: NEC LCD Technologies, Ltd., Kanagawa (JP)

( * ) Notice: Subject to any disclaimer, the term of this patent is extended or adjusted under 35 U.S.C. 154(b) by 717 days.

(21) Appl. No.: 11/247,238

(22) Filed: Oct. 12, 2005

(65) Prior Publication Data

US 2006/0077202 A1 Apr. 13, 2006

(30) Foreign Application Priority Data

Oct. 13, 2004 (JP) ..... 2004-299172

(51) Int. Cl.
*G06F 3/038* (2006.01)
*G09G 5/00* (2006.01)
*G09G 3/36* (2006.01)

(52) U.S. Cl. ..... 345/213; 345/99

(58) Field of Classification Search ..... 345/213, 345/87, 94–100
See application file for complete search history.

(56) References Cited

U.S. PATENT DOCUMENTS

| | | | | |
|---|---|---|---|---|
| 5,563,623 | A * | 10/1996 | Barrett, Jr. | 345/98 |
| 6,320,575 | B1 * | 11/2001 | Terashima et al. | 345/213 |
| 6,329,975 | B1 * | 12/2001 | Yamaguchi | 345/99 |
| 6,600,469 | B1 * | 7/2003 | Nukiyama et al. | 345/87 |
| 2001/0022571 | A1 * | 9/2001 | Nakano et al. | 345/98 |

FOREIGN PATENT DOCUMENTS

| | | | |
|---|---|---|---|
| JP | 6-175621 | A | 6/1994 |
| JP | 7-134571 | A | 5/1995 |
| JP | 9-258699 | A | 10/1997 |
| JP | 2740364 | A | 1/1998 |
| JP | 10-83174 | A | 3/1998 |
| JP | 10-148812 | A | 6/1998 |
| JP | 10-171397 | A | 6/1998 |
| JP | 10148812 | * | 6/1998 |
| JP | 10-260667 | A | 9/1998 |
| JP | 11-3070 | A | 1/1999 |
| JP | 11-69263 | A | 3/1999 |
| JP | 11-143448 | A | 5/1999 |
| JP | 11-149066 | A | 6/1999 |
| JP | 2001-83927 | A | 3/2001 |

(Continued)

*Primary Examiner*—Amr Awad
*Assistant Examiner*—Andre Matthews
(74) *Attorney, Agent, or Firm*—Sugrhue Mion, PLLC

(57) ABSTRACT

A mode-selecting apparatus for selecting one of a first mode in which images are displayed on a display unit in accordance with a vertical synchronization control signal and a horizontal synchronization control signal, and a second mode in which images are displayed on the display unit in accordance with a data-enable signal, includes a first unit which counts a number of input horizontal synchronization control signals in each of frame periods, a second unit which counts a number of input data-enable signals in each of frame periods, and a third unit which selects one of the first and second modes in accordance with both the number of input horizontal synchronization control signals and the number of input data-enable signals.

25 Claims, 7 Drawing Sheets

FOREIGN PATENT DOCUMENTS

| | | | |
|---|---|---|---|
| JP | 2001-92401 | A | 4/2001 |
| JP | 2001-236052 | A | 8/2001 |
| JP | 2002-202768 | A | 7/2002 |
| JP | 2002-278493 | A | 9/2002 |
| JP | 2003-167545 | A | 6/2003 |

* cited by examiner

MODE-SELECTING APPARATUS, DISPLAY APPARATUS INCLUDING THE SAME, AND METHOD OF SELECTING A MODE IN DISPLAY UNIT

BACKGROUND OF THE INVENTION

1. Field of the Invention

The invention relates to a mode-selecting apparatus for selecting a first mode or a second mode in a display unit, a display apparatus including the mode-selecting apparatus, and a method of selecting a first mode or a second mode in a display unit.

2. Description of the Related Art

For instance, Japanese Patent Application Publication No. 10-148812 (A) has suggested a liquid crystal display device having a function of automatically judging whether images are displayed in a liquid crystal display panel in accordance with either a vertical synchronization control (VSC) signal and a horizontal synchronization control (HSC) signal or a data-enable (DE) signal.

In the suggested liquid crystal display device, if VSC and HSC signals are input into a liquid crystal display panel, the detection of synchronization is carried out in accordance with the VSC and HSC signals, even when a DE signal is input into a liquid crystal display panel.

The suggested liquid crystal display device is designed to count a number of dot clocks received in a high level period or a low level period of the VSC signal in order to judge whether the VSC signal, the HSC signal or the DE signal is input thereinto. If a number of dot clocks is greater than a predetermined number, the liquid crystal display device judges that the VSC signal is not received. If a high period and a low period of the HSC and DE signals are longer than a predetermined period, the liquid crystal display device judges that the HSC and DE signals are not received.

Since the above-mentioned liquid crystal display device is designed to carry out the detection of synchronization in accordance with the VSC and HSC signals, even if the DE signal is input into the liquid crystal display device, the liquid crystal display device is accompanied with a problem that it fails to accomplish the detection of synchronization, if the DE signal is input thereinto, and further if one of the VSC and HSC signals is input thereinto.

That is, when the liquid crystal display device receives only the VSC and DE signals (namely, when the HSC signal is not input), or when the liquid crystal display device receives only the HSC and DE signals (namely, when the VSC signal is not input), the liquid crystal display device cannot accurately judge a synchronization signal as a reference signal.

Furthermore, since it is necessary in the above-mentioned liquid crystal display device to count a number of dot clocks associated with one frame in order to judge whether the VSC signal is input thereinto, a circuit size of a counter for counting a number of dot clocks is unavoidably increased.

Japanese Patent Application Publication No. 2001-83927 (A) has suggested a display unit including a first circuit for decoding image signals to thereby output a digital image signal, a synchronization signal, a panel enable signal and a dot clock signal, a second circuit for identifying a polarity of the panel enable signal and outputting a signal having a fixed polarity, the first counter for measuring a difference in phase between leading and trailing edges of the panel enable signal in the unit of a dot clock to thereby detect a horizontal resolution, and a second counter for measuring a period of time during which the panel enable signal is maintained to thereby detect a vertical resolution.

Japanese Patent Application Publication No. 2001-92401 (A) has suggested a mode-selecting circuit comprised of a horizontal dot counter having a first divider, and a vertical line counter having a second divider. Until the horizontal dot counter and the vertical line counter overflow, the first and second dividers are not driven, and counts counted by the horizontal dot counter and the vertical line counter are input into an input-mode identifier. If the horizontal dot counter overflows, the first divider is driven, and the count counted by the horizontal dot counter is compensated for with a dividing ratio of the first divider. The thus compensated count is input into the input-mode identifier. If the vertical line counter overflows, the second divider is driven, and the count counted by the vertical line counter is compensated for with a dividing ratio of the second divider. The thus compensated count is input into the input-mode identifier.

Japanese Patent Application Publication No. 2001-236052 (A) has suggested a display driver for producing a control signal to apply predetermined signal-processing to an image signal in accordance with a synchronization signal included in the image signal, including a first unit which produces a first signal indicative of variance in a timing of a first synchronization signal included in the image signal, a second unit which produces a first reference signal in accordance with the first synchronization signal, a third unit which determines a tolerance for timing variance of the first synchronization signal, in accordance with a second synchronization signal independent of the first synchronization signal, a fourth unit which produces a second reference signal in accordance with the second synchronization signal, a fifth unit which judges whether a predetermined timing of the first signal is in the tolerance, and a sixth unit which selects one of the first and second reference signals in accordance with the result of the judge carried out by the fifth unit, and outputs the selection as the control signal.

Japanese Patent Application Publication No. 2002-278493 (A) has suggested an image display device including a line-counting circuit which counts data enable signals indicating that image signals are valid, and judges whether a number of the thus counted data enable signals is equal to or greater than a predetermined number, a controller which, when a number of the thus counted data enable signals is equal to or greater than the predetermined number, detects vertical synchronization by virtue of the data enable signals to output a vertical synchronization signal, and a scanning circuit which vertically scans an image-display area in accordance with the vertical synchronization signal.

Japanese Patent Application Publication No. 7-134571 (A) has suggested a driver circuit for driving a liquid crystal panel in each of fields with an image signal, including first means for counting horizontal synchronization signals, based on vertical synchronization signals of image signals to be input in order to obtain a number N of drive horizontal lines in a field, second means for detecting that a total number M of drive lines of the liquid crystal panel is greater than the number N, and third means for masking reset signals for resetting the first means, from inputting thereinto, while the number M is greater than the number N.

Japanese Patent Application Publication No. 10-83174 (A) has suggested a display unit which identifies a display mode of an image signal in accordance with a synchronization signal, including a first device for separating synchronization signals from an input image signal, a second device for generating a clock signal, a third device for controlling the synchronization signals, a fourth device for measuring a cycle of a horizontal synchronization signal, a fifth device for measuring a cycle of a vertical synchronization signal, a memory for storing the measured cycles, and a sixth device for identifying a display mode in accordance with the cycles of the synchronization signals.

Japanese Patent Application Publication No. 10-260667 (A) has suggested a display device in which if a data enable signal is not received in a vertically scanning period, switching frame memories in accordance with a next vertical synchronization signal is not carried out.

Japanese Patent Application Publication No. 11-69263 (A) has suggested a vertical blanking producing circuit including a first counter which counts dot clocks synchronizing with a horizontal synchronization signal, and is reset with a vertical synchronization signal, a first decoder which decodes signals transmitted from the first counter, and outputs a pulse, a second counter which counts horizontal synchronization signals, and is reset with a vertical synchronization signal, a second decoder which decodes signals transmitted from the second counter, and outputs a pulse, and a first S-R-FF circuit which is set by the pulse transmitted from the first decoder and reset by the pulse transmitted from the second decoder, and outputs a vertical blanking signal.

Japanese Patent Application Publication No. 11-143448 (A) has suggested a memory controller including first and second counters each having reset and enable functions, and a block which detects vertical and horizontal synchronization signals. The first counter is reset by the vertical synchronization signal detected by the block. An enable signal of the first counter and a reset signal of the second counter are controlled by the horizontal synchronization signal detected by the block. An enable signal of the second counter is controlled with a signal indicative of an effective period of images, and addresses of a memory are controlled by the first and second counters.

Japanese Patent No. 2740364 (B2) (Japanese Patent Application Publication No. 4-304787) has suggested an apparatus for inserting a title image, including a memory storing image data, a vertical counter which receives a horizontal synchronization signal of an input video signal as a clock signal, and a vertical synchronization signal of the input video signal as a reset signal, and outputs address data with which image data in a first address range is read out of the memory, a scroll counter which receives the horizontal synchronization signal as a clock signal, resets itself at a cycle different from that of the vertical counter, and outputs address data with which image data in a second address range different from the first address range, a switch for selectively switching the address data transmitted from the vertical and scroll counters, and stores the selected one into the memory, a control circuit which operates in accordance with the vertical synchronization signal of the input video signal, and controls the switch in accordance with scroll commands, and means for inserting a title image signal including the image data read out of the memory, into the input video signal.

SUMMARY OF THE INVENTION

In view of the above-mentioned problems in the conventional liquid crystal display device, it is an object of the present invention to provide a mode-selecting apparatus which is capable of accurately judging a synchronization signal as a reference signal in all of combinations in which the VSC, HSC and DE signals are input thereinto or are not input thereinto, that is, which is capable of accurately judging a synchronization signal as a reference signal when the mode-selecting apparatus receives only the VSC and DE signals (namely, when the HSC signal is not input thereinto), or when the mode-selecting apparatus receives only the HSC and DE signals (namely, when the VSC signal is not input thereinto).

It is also an object of the present invention to provide a display apparatus including the above-mentioned mode-selecting apparatus, and a method of selecting a first mode or a second mode in a display unit, both of which are capable of doing the same as mentioned above.

Hereinbelow are described a mode-selecting apparatus, a display apparatus including the mode-selecting apparatus, and a method of selecting a first mode or a second mode in a display unit, all in accordance with the present invention through the use of reference numerals used in later described embodiments. The reference numerals are indicated only for the purpose of clearly showing correspondence between claims and the embodiments. It should be noted that the reference numerals are not allowed to interpret claims of the present application.

In one aspect of the present invention, there is provided a mode-selecting apparatus (100) for selecting one of a first mode in which images are displayed on a display unit (205) in accordance with a vertical synchronization control signal (VSC) and a horizontal synchronization control signal (HSC), and a second mode in which images are displayed on the display unit in accordance with a data-enable signal (DE), including a first unit (10) which counts a number of input horizontal synchronization control signals (HSC) in each of frame periods, a second unit (20) which counts a number of input data-enable signals (DE) in each of frame periods, and a third unit (40) which selects one of the first and second modes in accordance with both the number of input horizontal synchronization control signals (HSC) and the number of input data-enable signals (DE).

It is preferable that the first unit (10) resets the number of input horizontal synchronization control signals (HSC), and the second unit (20) resets the number of input data-enable signals (DE).

It is preferable that the first unit (10) resets the number of input horizontal synchronization control signals (HSC) at a timing at which each of frame periods starts, and the second unit (20) resets the number of input data-enable signals (DE) at the timing.

It is preferable that the timing is defined by a signal having a frame period and produced in accordance with the data-enable signals (DE), and the vertical synchronization control signals (VSC).

It is preferable that the timing is a timing at which the first signal rises up, or a timing at which the vertical synchronization control signal (VSC) rises up.

It is preferable that the first unit (10) detects a first timing at which the number of input horizontal synchronization control signals (HSC) is equal to M wherein M indicates a predetermined positive integer, and the second unit (20) detects a second timing at which the number of input data-enable signals (DE) is equal to N wherein N indicates a predetermined positive integer smaller than the M, in which case, the third unit (40) selects the first mode if the number of input data-enable signals (DE) is equal to zero (0) at an earlier timing among the first and second timings, and selects the second mode if the number of input data-enable signals (DE) is not equal to zero (0) at an earlier timing among the first and second timings.

It is preferable that the first unit (10) produces a first target-arrival signal at the first timing, and the second unit (20) produces a second target-arrival signal at the second timing, and further including a fourth unit (30) which produces a logical-sum signal at a timing at which at least one of the first and second target-arrival signal is produced, in which case, the third unit (40) selects the first mode if the number of input data-enable signals (DE) is equal to zero (0) at a timing at which the logical-sum signal is produced, and selects the second mode if the number of input data-enable signals (DE) is not equal to zero (0) at a timing at which the logical-sum signal is produced.

It is preferable that the first unit (10) resets the first target-arrival signal, and the second unit (20) resets the second target-arrival signal.

It is preferable that the first unit (10) resets the first target-arrival signal at a timing at which each of frame periods ends, and the second unit (20) resets the second target-arrival signal at a timing at which each of frame periods ends.

It is preferable that the timing is defined by one of a second signal having a frame period and produced in accordance with the data-enable signals (DE), and the vertical synchronization control signals (VSC).

It is preferable that the timing is an earlier timing among a timing at which the second signal falls down, and a timing at which the vertical synchronization control signal (VSC) falls down.

It is preferable that the N is greater than a maximum number of the horizontal synchronization control signals (HSC) which can be input thereinto in a non-display period in each of frame periods.

It is preferable that the first and second units (10, 20) re-count the number of input horizontal synchronization control signals (HSC) and the number of the input data-enable signals (DE), starting from zero (0), after the number of input horizontal synchronization control signals (HSC) and the number of the input data-enable signals (DE) reached maximum numbers countable by the first and second units (10, 20).

There is further provided a mode-selecting apparatus (100) for selecting one of a first mode in which images are displayed on a display unit (205) in accordance with a vertical synchronization control signal (VSC) and a horizontal synchronization control signal (HSC), and a second mode in which images are displayed on the display unit in accordance with a data-enable signal (DE), including a first unit (10) which counts a number of input horizontal synchronization control signals (HSC), and resets the number of input horizontal synchronization control signals (HSC), a second unit (20) which counts a number of input data-enable signals (DE), and resets the number of input data-enable signals (DE), and a third unit (40) which selects one of the first and second modes in accordance with both the number of input horizontal synchronization control signals (HSC) and the number of input data-enable signals (DE).

There is still further provided a mode-selecting apparatus (100) for selecting one of a first mode in which images are displayed on a display unit (205) in accordance with a vertical synchronization control signal (VSC) and a horizontal synchronization control signal (HSC), and a second mode in which images are displayed on the display unit in accordance with a data-enable signal (DE), including a first unit (10) which (a) counts a number of input horizontal synchronization control signals (HSC), (b) resets the number of input horizontal synchronization control signals (HSC) at each of a timing at which a n-VALID signal having a frame period and produced in accordance with the data-enable signal (DE) rises up, and a timing at which the vertical synchronization control signal (VSC) rises up, (c) produces a HC-RC signal designed to be in a high level at a first timing at which the number of input horizontal synchronization control signals (HSC) is equal to M wherein M indicates a predetermined positive integer, and (d) resets the HC-RC signal into a low level at an earlier timing among a timing at which the n-VALID signal falls down, and a timing at which the vertical synchronization control signal (VSC) falls down, a second unit (20) which (a) counts a number of input data-enable signal (DE)s, (b) resets the number of input data-enable signal (DE)s at each of a timing at which a signal having a frame period and produced in accordance with the data-enable signal (DE) rises up, and a timing at which the vertical synchronization control signal (VSC) rises up, (c) produces a DC-RC signal designed to be in a high level at a second timing at which the number of input data-enable signal (DE)s is equal to N wherein N indicates a predetermined positive integer smaller than the M, and (d) resets the DC-RC signal into a low level at an earlier timing among a timing at which the n-VALID signal falls down, and a timing at which the vertical synchronization control signal (VSC) falls down, a third unit (40) which selects one of the first and second modes, and a fourth unit (30) which produces a logical-sum signal designed to be in a high level at a timing at which at least one of the HC-RC signal and the DC-RC signal is in a high level, the third unit (40) selecting the first mode if the number of input data-enable signals (DE) is equal to zero (0) at a timing at which the logical-sum signal was produced, and selecting the second mode if the number of input data-enable signals (DE) is not equal to zero (0) at the timing.

In another aspect of the present invention, there is provided a display apparatus (200) including a display unit (205), and the above-mentioned mode-selecting apparatus (100).

It is preferable that the display apparatus is comprised of a liquid crystal display unit including a liquid crystal display panel as the display unit.

In still another aspect of the present invention, there is provided a method of selecting one of a first mode in which images are displayed on a display unit in accordance with a vertical synchronization control signal (VSC) and a horizontal synchronization control signal (HSC), and a second mode in which images are displayed on the display unit in accordance with a data-enable signal (DE), including counting a number of input horizontal synchronization control signals (HSC) in each of frame periods, counting a number of input data-enable signals (DE) in each of frame periods, and selecting one of the first and second modes in accordance with both the number of input horizontal synchronization control signals (HSC) and the number of input data-enable signals (DE).

The method may further include resetting the number of input horizontal synchronization control signals (HSC), and resetting the number of input data-enable signals (DE).

It is preferable that the number of input horizontal synchronization control signals (HSC) is reset at a timing at which each of frame periods starts, and the number of input data-enable signals (DE) is reset at the timing.

The method may further include detecting a first timing at which the number of input horizontal synchronization control signals (HSC) is equal to M wherein M indicates a predetermined positive integer, detecting a second timing at which the number of input data-enable signals (DE) is equal to N wherein N indicates a predetermined positive integer smaller than the M, and selecting either the first mode if the number of input data-enable signals (DE) is equal to zero (0) at an earlier timing among the first and second timings, or the second mode if the number of input data-enable signals (DE) is not equal to zero (0) at an earlier timing among the first and second timings.

The method may further include producing a first target-arrival signal at the first timing, producing a second target-arrival signal at the second timing, producing a logical-sum signal at a timing at which at least one of the first and second target-arrival signal is produced, selecting either the first mode if the number of input data-enable signals (DE) is equal to zero (0) at a timing at which the logical-sum signal is produced, or the second mode if the number of input data-enable signals (DE) is not equal to zero (0) at a timing at which the logical-sum signal is produced.

The method may further include resetting the first target-arrival signal at a timing at which each of frame periods ends, and resetting the second target-arrival signal at a timing at which each of frame periods ends.

There is further provided a method of selecting one of a first mode in which images are displayed on a display unit in accordance with a vertical synchronization control signal (VSC) and a horizontal synchronization control signal (HSC), and a second mode in which images are displayed on the display unit in accordance with a data-enable signal (DE), including counting a number of input horizontal synchronization control signals (HSC), counting a number of input data-enable signals (DE), resetting the number of input horizontal synchronization control signals (HSC), resetting the number of input data-enable signals (DE), and selecting one of the first and second modes in accordance with both the number of input horizontal synchronization control signals (HSC) and the number of input data-enable signals (DE).

There is still further provided a method of selecting one of a first mode in which images are displayed on a display unit in accordance with a vertical synchronization control signal (VSC) and a horizontal synchronization control signal (HSC), and a second mode in which images are displayed on the display unit in accordance with a data-enable signal (DE), including counting a number of input horizontal synchronization control signals (HSC), counting a number of input data-enable signals (DE), resetting the number of input horizontal synchronization control signals (HSC) at each of a timing at which a n-VALID signal having a frame period and produced in accordance with the data-enable signal (DE) rises up, and a timing at which the vertical synchronization control signal (VSC) rises up, resetting the number of input data-enable signals (DE) at each of a timing at which a signal having a frame period and produced in accordance with the data-enable signal (DE) rises up, and a timing at which the vertical synchronization control signal (VSC) rises up, producing a HC-RC signal designed to be in a high level at a first timing at which the number of input horizontal synchronization control signals (HSC) is equal to M wherein M indicates a predetermined positive integer, producing a DC-RC signal designed to be in a high level at a second timing at which the number of input data-enable signals (DE) is equal to N wherein N indicates a predetermined positive integer smaller than the M, producing a logical-sum signal designed to be in a high level at a timing at which at least one of the HC-RC signal and the DC-RC signal is in a high level, resetting the HC-RC signal into a low level at an earlier timing among a timing at which the n-VALID signal falls down, and a timing at which the vertical synchronization control signal (VSC) falls down, resetting the DC-RC signal into a low level at an earlier timing among a timing at which the n-VALID signal falls down, and a timing at which the vertical synchronization control signal (VSC) falls down, and selecting the first mode if the number of input data-enable signal (DE)s is equal to zero (0) at a timing at which the logical-sum signal was produced, and selecting the second mode if the number of input data-enable signal (DE)s is not equal to zero (0) at the timing.

The advantages obtained by the aforementioned present invention will be described hereinbelow.

In accordance with the present invention, it is possible to accurately judge a synchronization signal as a reference signal in all of combinations in which the VSC, HSC and DE signals are input or are not input.

Accordingly, it is possible to accurately judge a synchronization signal as a reference signal when a mode-selecting apparatus receives only the VSC and DE signals (namely, when the HSC signal is not input thereinto), or when a mode-selecting apparatus receives only the HSC and DE signals (namely, when the VSC signal is not input thereinto).

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

A liquid crystal display device as a preferred embodiment of the display apparatus in accordance with the present invention, a mode-selecting circuit as a preferred embodiment of the mode-selecting apparatus for selecting a first mode or a second mode in a display unit, and a method of selecting a first mode or a second mode in a display unit, in accordance with an embodiment of the present invention are explained hereinbelow.

Hereinbelow, a drive mode in which images are displayed in a display screen (for instance, a liquid crystal display panel in the embodiment mentioned hereinbelow) of a display unit in accordance with a vertical synchronization control (VSC) signal and a horizontal synchronization control (HSC) signal as reference signals is called a fixed mode ("a first mode" defined in claims), and a drive mode in which images are displayed in a display screen of a display unit in accordance with a data-enable (DE) signal as a reference signal is called a DE mode ("a second mode" defined in claims).

Figure 1:
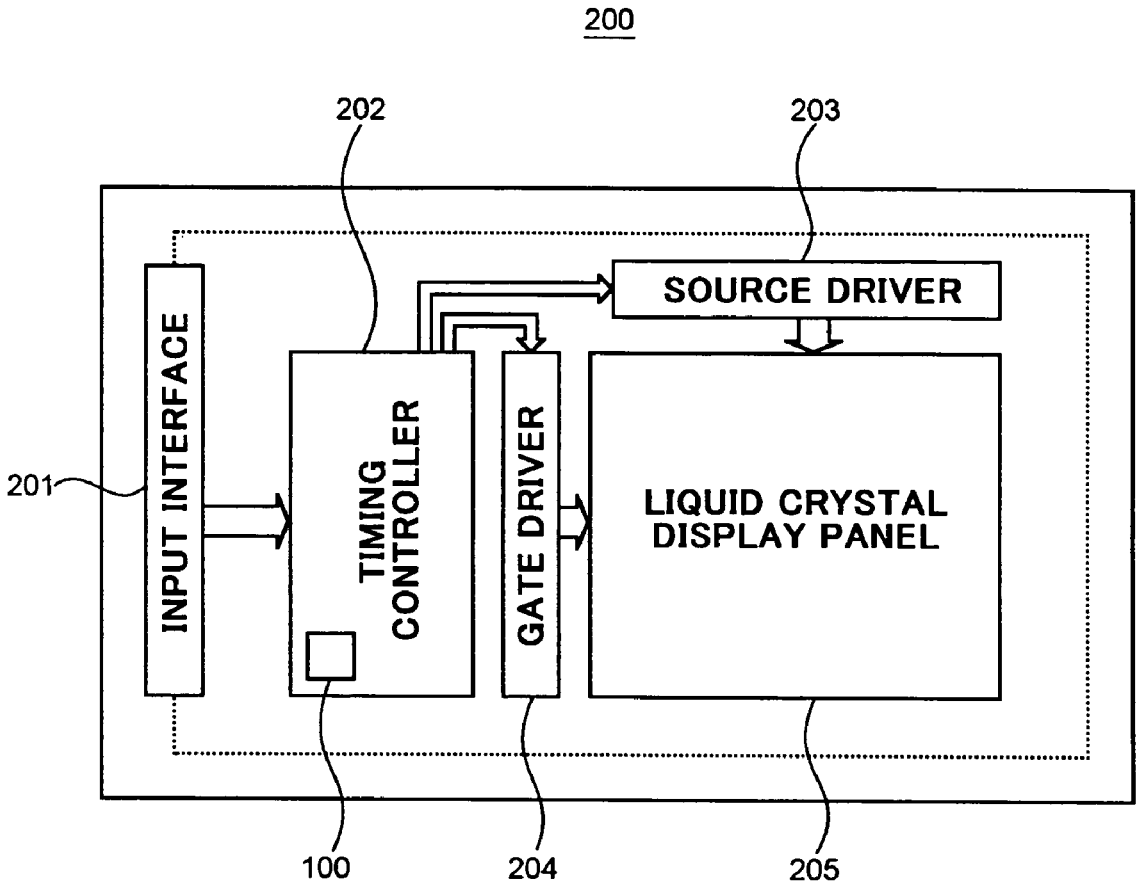
FIG. 1 is a block diagram of a liquid crystal display device in accordance with an embodiment of the present invention.

FIG. 1 is a block diagram of a liquid crystal display device 200 in accordance with an embodiment of the present invention.

As illustrated in FIG. 1, the liquid crystal display device 200 is comprised of an input interface 201 into which external signals are input, a timing controller 202 which controls a timing at which a signal transmitted from the input interface 201 is output, a source driver 203, a gate driver 204, and a liquid crystal display panel 205.

The input interface 201 receives a vertical synchronization control (VSC) signal, a horizontal synchronization control (HSC) signal, a data-enable (DE) signal, a dot clock signal, and a plurality of data signals from external devices such as a personal computer.

The signals having been input into the input interface 201 are output to the timing controller 202 from the input interface 201.

In the fixed mode, the timing controller 202 controls the source driver 203 and the gate driver 204 in accordance with the VSC and HSC signals to thereby cause the liquid crystal display panel 205 to display images under the control of the source driver 203 and the gate driver 204. In the DE mode, the timing controller 202 controls the source driver 203 and the gate driver 204 in accordance with the DE signal to thereby cause the liquid crystal display panel 205 to display images under the control of the source driver 203 and the gate driver 204.

The timing controller 202 includes a mode-selecting circuit 100 to select the fixed mode or the DE mode.

Figure 2:
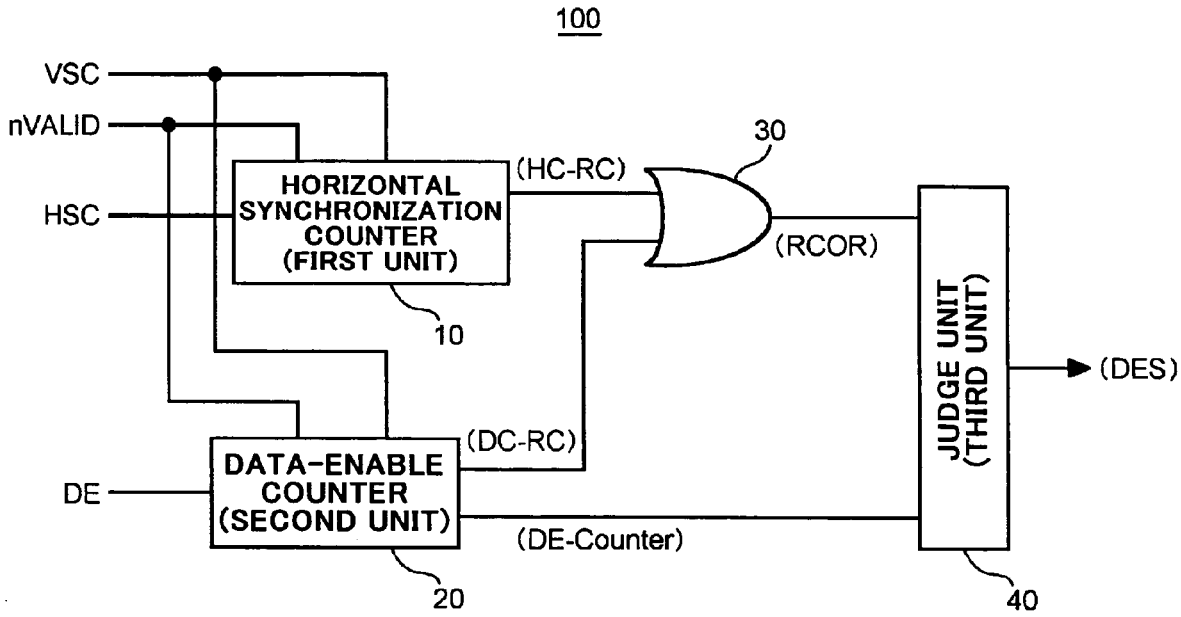
FIG. 2 is a block diagram of a mode-selecting circuit in accordance with an embodiment of the present invention.

FIG. 2 is a block diagram of the mode-selecting circuit 100 in accordance with an embodiment of the present invention.

The mode-selecting circuit 100 in accordance with an embodiment of the present invention selects the fixed mode or the DE mode as a mode in accordance with which the liquid crystal display device 200 operates, in accordance with signals input thereinto.

As illustrated in FIG. 2, the mode-selecting circuit 100 is comprised of a horizontal synchronization counter 10, a data-enable counter 20, an OR circuit 30, and a judge unit 40.

The horizontal synchronization counter 10 counts a number of horizontal synchronization control (HSC) signals input thereinto in each of frame periods.

Specifically, the horizontal synchronization counter 10 receives a vertical synchronization control (VSC) signal and a n-VALID signal as reset signals, and further receives the HSC signal as a signal to be counted.

The horizontal synchronization counter 10 resets the counted number into zero (0) at timings at which the VSC and n-VALID signals as reset signals rise up.

On receipt of the HSC signal, the horizontal synchronization counter 10 starts counting up. As a result of starting counting up each time the HSC signal is input into the horizontal synchronization counter 10, after a count reached a full count (that is, a maximum number HSCmax of the HSC signals countable by the horizontal synchronization counter 10), the horizontal synchronization counter 10 restarts counting up from zero (0).

The horizontal synchronization counter 10 produces a HC-RC signal which turns to a high level from a low level at a first timing at which a count of the HSC signals reaches M, wherein M indicates a predetermined positive integer, and outputs the thus produced HC-RC signal to the OR circuit 30. Herein, the HC-RC signal at a high level corresponds to the first target-arrival signal defined in claims.

In addition, the horizontal synchronization counter 10 resets the HC-RC signal, that is, switches the HC-RC signal to a low level from a high level at an earlier timing among a timing at which the VSC signal falls down and a timing at which the n-VALID signal falls down.

The data-enable counter 20 counts a number of the data-enable signals in each of frame periods.

Specifically, the data-enable counter 20 receives the VSC signal and the n-VALID signal both as reset signals, and further receives the DE signal as a signal to be counted.

The data-enable counter 20 resets the counted number into zero (0) at timings at which the VSC and n-VALID signals as reset signals rise up.

On receipt of the DE signal, the data-enable counter 20 starts counting up. As a result of starting counting up each time the DE signal is input into the data-enable counter 20, after a count reached a full count (that is, a maximum number DEmax of the DE signals countable by the data-enable counter 20), the data-enable counter 20 restarts counting up from zero (0).

The data-enable counter 20 produces a DC-RC signal which turns to a high level from a low level at a second timing at which a count of the DE signals reaches N, wherein N indicates a predetermined positive integer smaller than the above-mentioned integer M, and outputs the thus produced DC-RC signal to the OR circuit 30. Herein, the DC-RC signal at a high level corresponds to the second target-arrival signal defined in claims.

In addition, the data-enable counter 20 resets the DC-RC signal, that is, switches the DC-RC signal to a low level from a high level at an earlier timing among a timing at which the VSC signal falls down and a timing at which the n-VALID signal falls down.

The n-VALID signal has a frame period, and is produced based on the DE signal. Accordingly, when the DE signal is not input into the mode-selecting circuit 100, the n-VALID signal is not produced, and hence, is not input into the mode-selecting circuit 100.

The above-mentioned integers M and N are selected among integers meeting with the following conditions (A) to (E).

(A) The integer M is greater than the integer N (M>N). This is for preferentially using the DE signal as a reference signal, when both of the VSC and DE signals are input into the mode-selecting circuit 100 as reference signals.

(B) The integer M is designed to be sufficiently smaller than the full count of the horizontal synchronization counter 10, that is, the maximum number HSCmax of the HSC signals.

(C) The integer N is designed to be sufficiently smaller than the full count of the data-enable counter 10, that is, the maximum number DEmax of the DE signals.

(D) The integer N is designed to be greater than a number of lines of the VSC signal in a non-display period. That is, the integer N is designed to be greater than a maximum number of the HSC signals to be able to be input into the mode-selecting circuit 100 in a non-display period in each of frame periods. Herein, the maximum number corresponds to a maximum number of the horizontal synchronization signals to be able to be input into the mode-selecting circuit 100 in a non-display period in each of frame periods. This is for disabling a number of the DE signals counted by the data-enable counter 20 to reach the integer N after a timing at which the VSC signal rises up until a timing at which the n-VALID signal rises up, when both of the VSC and DE signals are input into the mode-selecting circuit 100, that is, when both of the VSC and n-VALID signals are input into the mode-selecting circuit 100.

The OR circuit 30 receives the HC-RC signal from the horizontal synchronization counter 10, and the DC-RC signal from the data-enable counter 20. The OR circuit 30 produces a RCOR signal comprised of a logical sum (logical OR) of the HC-RC and DC-RC signals, and outputs the thus produced RCOR signal into the judge unit 40.

The RCOR signal is in a high level when at least one of the HC-RC and DC-RC signals is in a high level, and is in a low level when both of the HC-RC and DC-RC signals are in a low level.

The judge unit 40 judges whether the fixed mode or the DE mode should be selected, in accordance with the number of HSC signals counted by the horizontal synchronization counter 10 and the number of DE signals counted by the data-enable counter 20.

The judge unit 40 receives the RCOR signal from the OR circuit 30 and the number of DE signals from the data-enable counter 20.

The judge unit 40 produces a judge signal DES in accordance with the RCOR signal transmitted from the OR circuit 30 and the number of DE signals counted by the data-enable counter 20.

The judge signal DES is in a high level, if the number of DE signals counted by the data-enable counter 20 is equal to zero (0) at a timing at which the RCOR signal rises up, and is in a low level, if the number of DE signals counted by the data-enable counter 20 is greater than zero (0) at a timing at which the RCOR signal rises up.

The judge signal DES indicates one of the fixed mode and the DE mode. Specifically, the judge signal DES having a high level indicates the fixed mode, and the judge signal DES having a low level indicated the DE mode.

For instance, the timing controller 202 includes a selection circuit (not illustrated) downstream of the mode-selecting circuit 100. The selection circuit selects either the VSC and HSC signals or the DE signal as a reference signal.

The selection circuit receives the judge signal DES from the judge unit 40. The selection circuit selects the VSC and HSC signals as a reference signal, if the judge signal DES is in a high level, and selects the DE signal as a reference signal, if the judge signal DES is in a low level.

Hereinbelow is explained an operation of the mode-selecting circuit 100 in each of five combinations of input signal(s) among the VSC, HSC and DE signals, with reference to FIGS. 3 to 7.

Figure 3:
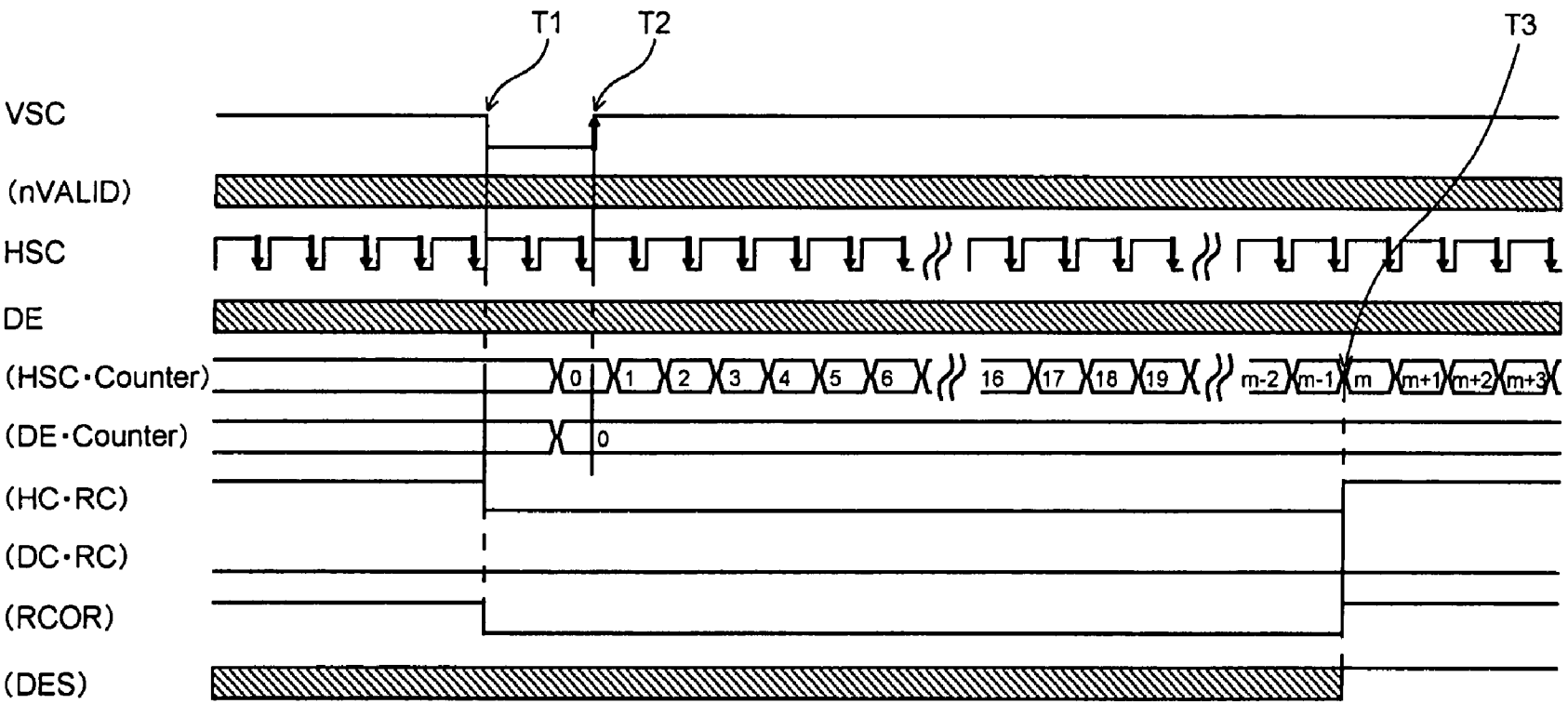
FIG. 3 is a timing chart showing an operation of the mode-selecting apparatus illustrated in FIG. 2.

FIG. 3 is a timing chart showing an operation of the mode-selecting circuit 100 when the VSC and HSC signals are input into the mode-selecting circuit 100, but the DE signal is not input into the mode-selecting circuit 100.

The horizontal synchronization counter 10 resets the HC-RC signal and the data-enable counter 20 resets the DC-RC signal, that is, the horizontal synchronization counter 10 switches the HC-RC signal to a low level from a high level and the data-enable counter 20 switches the DC-RC signal to a low level from a high level both at an earlier timing among timings at which the VSC and n-VALID signals fall down.

In the operation shown in FIG. 3, since the DE signal is not input into the mode-selecting circuit 100, the n-VALID signal is not produced.

Thus, among the VSC and n-VALID signals both defining a timing at which the HC-RC and DC-RC signals are reset, only the VSC signal is input into the horizontal synchronization counter 10 and the data-enable counter 20.

Accordingly, in the operation shown in FIG. 3, the HC-RC and DC-RC signals are reset, that is, switched to a low level from a high level by the horizontal synchronization counter 10 and the data-enable counter 20, respectively, at a timing T1 at which the VSC signal falls down.

However, since the DC-RC signal is kept in a low level, only the HC-RC signal among the HC-RC and DC-RC signals is reset, that is, switched to a low level from a high level at the timing T1.

In addition, in the operation shown in FIG. 3, since the HC-RC signal is reset at the timing T1, the RCOR signal transmitted from the OR circuit 30 is reset, that is, switched to a low level from a high level at the timing T1.

The number of the HSC signals counted by the horizontal synchronization counter 10 and the number of the DE signals counted by the data-enable counter 20 are reset at a timing at which the VSC and n-VALID signals rise up.

In the operation shown in FIG. 3, since the DE signal is not input into the mode-selecting circuit 100, the n-VALID signal is not produced.

Thus, among the VSC and n-VALID signals both defining a timing at which the HC-RC and DC-RC signals are reset, only the VSC signal is input into the horizontal synchronization counter 10 and the data-enable counter 20.

Accordingly, in the operation shown in FIG. 3, the number of the HSC signals counted by the horizontal synchronization counter 10 and the number of the DE signals counted by the data-enable counter 20 are reset into zero (0) at a timing T2 at which the VSC signal rises up.

The horizontal synchronization counter 10 starts counting up on receipt of the HSC signal, and produces a HC-RC signal which turns to a high level from a low level at a timing T3 at which the number of the HSC signals counted by the horizontal synchronization counter 10 becomes equal to M. The thus produced HC-RC signal is output to the OR circuit 30.

Since the data-enable counter 20 does not receive the DE signal, the data-enable counter 20 does not count up. Thus, the number of the DE signals counted by the data-enable counter 20 remains zero (0) even at the timing T3, and the DC-RC signal remains in a low level at the timing T3.

Accordingly, the RCOR signal transmitted from the OR circuit 30 is switched to a high level from a low level at the same timing as the timing at which the HC-RC signal turns to a high level from a low level, that is, at the timing T3.

Since the number of the DE signals counted by the data-enable counter 20 remains zero (0) at a timing at which the RCOR signal rises up, that is, at the timing T3, the signal DES transmitted from the judge unit 40 turns to a high level at the timing T3. Accordingly, the mode-selecting circuit 100 selects the fixed mode.

Figure 4:
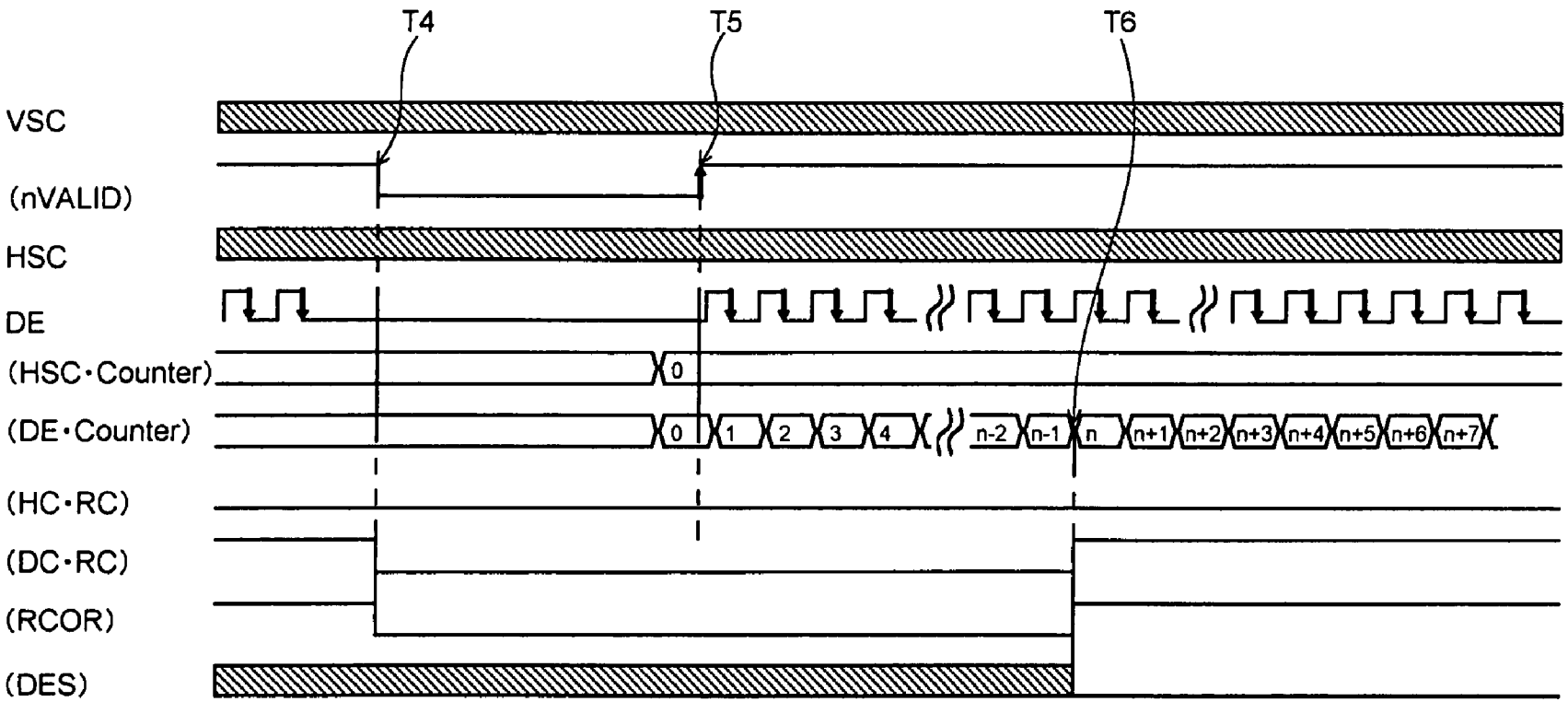
FIG. 4 is a timing chart showing an operation of the mode-selecting apparatus illustrated in FIG. 2.

FIG. 4 is a timing chart showing an operation of the mode-selecting circuit 100 when the VSC and HSC signals are not input into the mode-selecting circuit 100, but the DE signal is input into the mode-selecting circuit 100.

The horizontal synchronization counter 10 resets the HC-RC signal and the data-enable counter 20 resets the DC-RC signal, that is, the horizontal synchronization counter 10 switches the HC-RC signal to a low level from a high level and the data-enable counter 20 switches the DC-RC signal to a low level from a high level both at an earlier timing among timings at which the VSC and n-VALID signals fall down.

In the operation shown in FIG. 4, since the VSC signal is not input into the mode-selecting circuit 100, but the DE signal is input into the mode-selecting circuit 100, the n-VALID signal is produced and is input into the horizontal synchronization counter 10.

Thus, among the VSC and n-VALID signals both defining a timing at which the HC-RC and DC-RC signals are reset, only the n-VALID signal is input into the horizontal synchronization counter 10 and the data-enable counter 20.

Accordingly, in the operation shown in FIG. 4, the HC-RC and DC-RC signals are reset, that is, switched to a low level from a high level by the horizontal synchronization counter 10 and the data-enable counter 20, respectively, at a timing T4 at which the n-VALID signal falls down.

However, since the HC-RC signal is kept in a low level, only the DC-RC signal among the HC-RC and DC-RC signals is reset, that is, switched to a low level from a high level at the timing T4.

In addition, in the operation shown in FIG. 4, since the DC-RC signal is reset at the timing T4, the RCOR signal transmitted from the OR circuit 30 is reset, that is, switched to a low level from a high level at the timing T4.

The number of the HSC signals counted by the horizontal synchronization counter 10 and the number of the DE signals counted by the data-enable counter 20 are reset at a timing at which the VSC and n-VALID signals rise up.

In the operation shown in FIG. 4, since the VSC signal is not input into the mode-selecting circuit 100, but the DE signal is input into the mode-selecting circuit 100, the n-VALID signal is produced and input into the horizontal synchronization counter 10.

Thus, among the VSC and n-VALID signals both defining a timing at which the HC-RC and DC-RC signals are reset, only the n-VALID signal is input into the horizontal synchronization counter 10 and the data-enable counter 20.

Accordingly, in the operation shown in FIG. 4, the number of the HSC signals counted by the horizontal synchronization counter 10 and the number of the DE signals counted by the data-enable counter 20 are reset into zero (0) at a timing T5 at which the n-VALID signal rises up.

The data-enable counter 20 starts counting up on receipt of the DE signal, and produces a DC-RC signal which turns to a high level from a low level at a timing T6 at which the number of the DE signals counted by the data-enable counter 20 becomes equal to N. The thus produced DE signal is output to the OR circuit 30.

Since the horizontal synchronization counter 10 does not receive the HSC signal, the horizontal synchronization counter 10 does not count up. Thus, the number of the HSC signals counted by the horizontal synchronization counter 10 remains zero (0) even at the timing T6, and the HC-RC signal remains in a low level at the timing T6.

Accordingly, the RCOR signal transmitted from the OR circuit 30 is switched to a high level from a low level at the same timing as the timing at which the DC-RC signal turns to a high level from a low level, that is, at the timing T6.

Since the number of the DE signals counted by the data-enable counter 20 is N at a timing at which the RCOR signal rises up, that is, at the timing T6, the signal DES transmitted from the judge unit 40 turns to a low level at the timing T6. Accordingly, the mode-selecting circuit 100 selects the DE mode.

Figure 5:
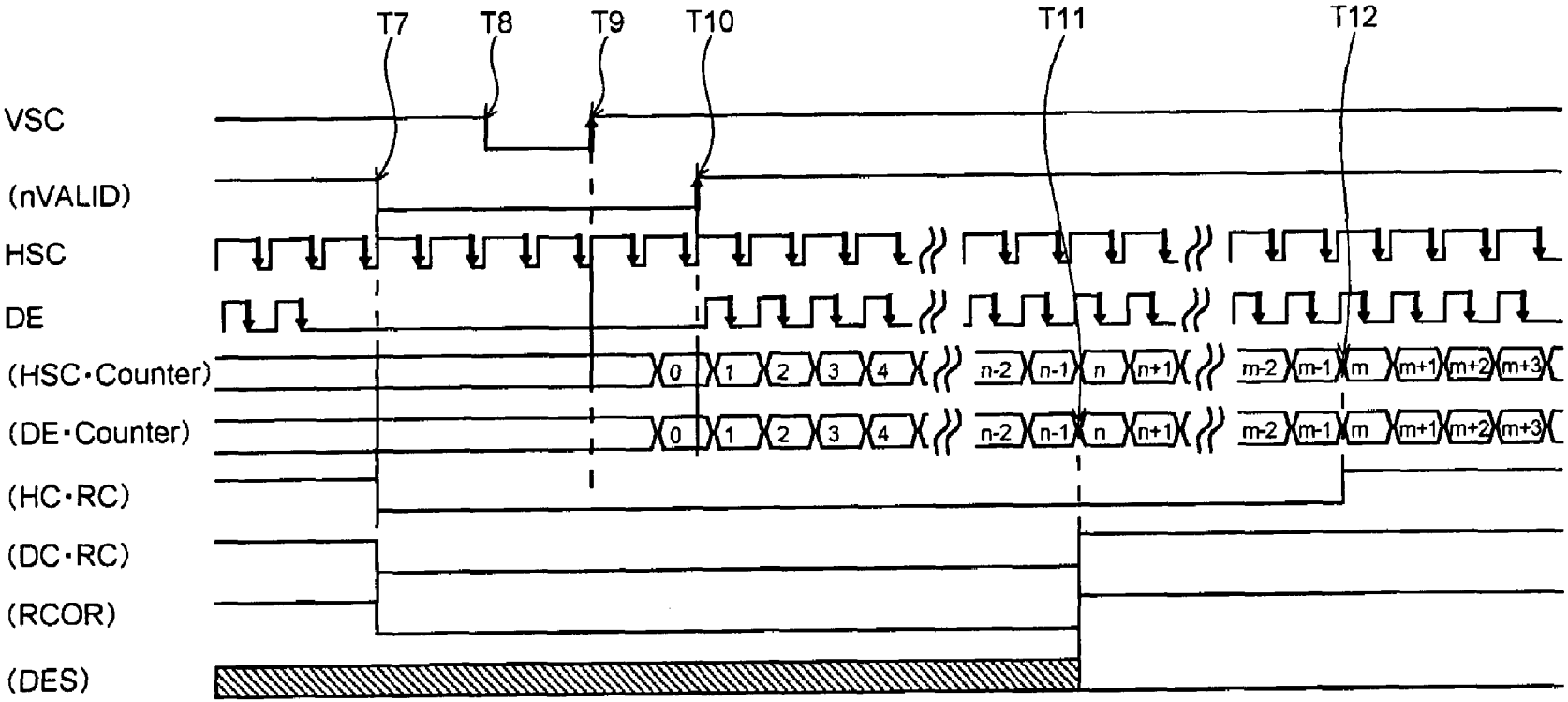
FIG. 5 is a timing chart showing an operation of the mode-selecting apparatus illustrated in FIG. 2.

FIG. 5 is a timing chart showing an operation of the mode-selecting circuit 100 when the VSC, HSC and DE signals are input into the mode-selecting circuit 100.

The horizontal synchronization counter 10 resets the HC-RC signal and the data-enable counter 20 resets the DC-RC signal, that is, the horizontal synchronization counter 10 switches the HC-RC signal to a low level from a high level and the data-enable counter 20 switches the DC-RC signal to a low level from a high level both at an earlier timing among timings at which the VSC and n-VALID signals fall down.

In the operation shown in FIG. 5, since the VSC and DE signals are input into the mode-selecting circuit 100, the n-VALID signal is produced and input into the horizontal synchronization counter 10.

Thus, among the VSC and n-VALID signals both defining a timing at which the HC-RC and DC-RC signals are reset, both the VSC and n-VALID signals are input into the horizontal synchronization counter 10 and the data-enable counter 20.

As shown in FIG. 5, since a timing T7 at which the n-VALID signal falls down is earlier than a timing T8 at which the VSC signal falls down, the HC-RC and DC-RC signals are reset, that is, switched to a low level from a high level by the horizontal synchronization counter 10 and the data-enable counter 20, respectively, at the timing T7 at which the VSC signal falls down.

In addition, in the operation shown in FIG. 5, since the HC-RC and DC-RC signals are reset at the timing T7, the RCOR signal transmitted from the OR circuit 30 is reset, that is, switched to a low level from a high level at the timing T7.

The number of the HSC signals counted by the horizontal synchronization counter 10 and the number of the DE signals counted by the data-enable counter 20 are reset at a timing at which the VSC and n-VALID signals rise up.

In the operation shown in FIG. 5, since the VSC and DE signals are input into the mode-selecting circuit 100, the n-VALID signal is produced, and is input into the horizontal synchronization counter 10.

As shown in FIG. 5, since a timing T9 at which the VSC signal rises up is earlier than a timing T10 at which the n-VALID signal rises up, the number of the HSC signals counted by the horizontal synchronization counter 10 and the number of the DE signals counted by the data-enable counter 20 are reset into zero (0) at the timing T9 at which the VSC signal falls down, and then, reset again into zero (0) at the timing T10 at which the n-VALID signal rises up.

The horizontal synchronization counter 10 and the data-enable counter 20 continues counting the HSC and DE signals, respectively, during the timing T9 to the timing T10. However, the number of the HSC signals counted by the horizontal synchronization counter 10 does not reach the integer M, and the number of the DE signals counted by the data-enable counter 20 does not reach the integer N.

This is because the integer M is greater than the integer N (M>N) as mentioned earlier, and further because the number of the DE signals counted during the timing T9 to the timing T10 must be smaller than the integer N, since the integer N is designed greater than a number of lines in a non-display period of the VSC signal.

On receipt of the DE signal, the data-enable counter 20 starts counting up at the timing T10, and produces a DC-RC signal which turns to a high level from a low level at a timing T11 at which the number of the DE signals counted by the data-enable counter 20 reaches the integer N. The thus produced DC-RC signal is output to the OR circuit 30.

On receipt of the HSC signal, the horizontal synchronization counter 10 starts counting up at the timing T10, and produces a HC-RC signal which turns to a high level from a low level at a timing T12 at which the number of the HSC signals counted by the horizontal synchronization counter 10 reaches the integer M. The thus produced HC-RC signal is output to the OR circuit 30.

In the operation shown in FIG. 5, since the HSC and DE signals have periods equal to each other, the number of the HSC signals counted by the horizontal synchronization counter 10 and the number of DE signals counted by the data-enable counter 20 increase in synchronization with each other.

Since the integer M is greater than the integer N (M>N) as mentioned earlier, the timing T11 at which the number of the DE signals counted by the data-enable counter 20 reaches the integer N, and thus, the DC-RC signal turns into a high level is earlier than the timing T12 at which the number of the HSC signals counted by the horizontal synchronization counter 10 reaches the integer M, and thus, the HC-RC signal turns into a high level.

The RCOR signal transmitted from the OR circuit 30 turns to a high level from a low level at the same timing as a timing at which the DC-RC signal transmitted from the data-enable counter 20 is turned into a high level from a low level, that is, at the timing T11.

Since the number of the DE signals counted by the data-enable counter 20 is N at the timing T11 at which the RCOR signal rises up, the signal DES transmitted from the judge unit 40 turns to a low level at the timing T11. Accordingly, the mode-selecting circuit 100 selects the DE mode.

Figure 6:
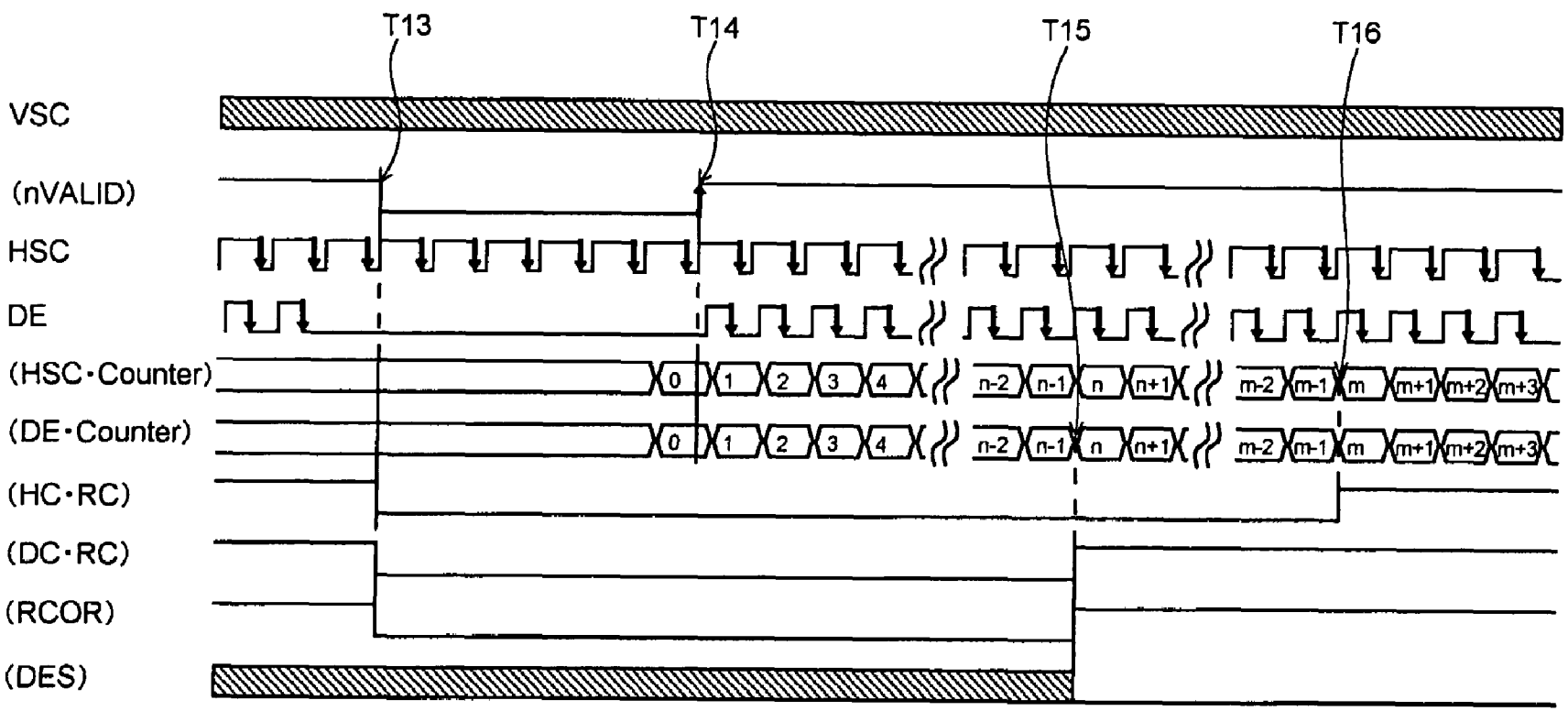
FIG. 6 is a timing chart showing an operation of the mode-selecting apparatus illustrated in FIG. 2.

FIG. 6 is a timing chart showing an operation of the mode-selecting circuit 100 when the VSC signal is not input into the mode-selecting circuit 100, but the HSC and DE signals are input into the mode-selecting circuit 100.

The horizontal synchronization counter 10 resets the HC-RC signal and the data-enable counter 20 resets the DC-RC signal, that is, the horizontal synchronization counter 10 switches the HC-RC signal to a low level from a high level and the data-enable counter 20 switches the DC-RC signal to a low level from a high level both at an earlier timing among timings at which the VSC and n-VALID signals fall down.

In the operation shown in FIG. 6, since the VSC is not input into the mode-selecting circuit 100, but the DE signal is input into the mode-selecting circuit 100, the n-VALID signal is produced and input into the horizontal synchronization counter 10.

Thus, among the VSC and n-VALID signals both defining a timing at which the HC-RC and DC-RC signals are reset, only the n-VALID signal is input into the horizontal synchronization counter 10 and the data-enable counter 20.

Accordingly, in the operation shown in FIG. 6, the HC-RC and DC-RC signals are reset, that is, switched to a low level from a high level by the horizontal synchronization counter 10 and the data-enable counter 20, respectively, at a timing T13 at which the n-VALID signal falls down.

In addition, in the operation shown in FIG. 6, since the HC-RC and DC-RC signals are reset at the timing T13, the RCOR signal transmitted from the OR circuit 30 is reset, that is, switched to a low level from a high level at the timing T13.

The number of the HSC signals counted by the horizontal synchronization counter 10 and the number of the DE signals counted by the data-enable counter 20 are reset at a timing at which the VSC and n-VALID signals rise up.

In the operation shown in FIG. 6, since the VSC signal is not input into the mode-selecting circuit 100, but the DE signal is input into the mode-selecting circuit 100, the n-VALID signal is produced and input into the horizontal synchronization counter 10.

Thus, among the VSC and n-VALID signals both defining a timing at which the HC-RC and DC-RC signals are reset, only the n-VALID signal is input into the horizontal synchronization counter 10 and the data-enable counter 20.

Accordingly, in the operation shown in FIG. 6, the number of the HSC signals counted by the horizontal synchronization counter 10 and the number of the DE signals counted by the data-enable counter 20 are reset into zero (0) at a timing T14 at which the n-VALID signal rises up.

The data-enable counter 20 starts counting up on receipt of the DE signal, and produces a DC-RC signal which turns to a high level from a low level at a timing T15 at which the number of the DE signals counted by the data-enable counter 20 becomes equal to N. The thus produced DE signal is output to the OR circuit 30.

The horizontal synchronization counter 10 starts counting up on receipt of the HSC signal, and produces a HC-RC signal which turns to a high level from a low level at a timing T16 at which the number of the HSC signals counted by the horizontal synchronization counter 10 reaches the integer M. The thus produced HC-RC signal is output to the OR circuit 30.

In the operation shown in FIG. 6, since the HSC and DE signals have periods equal to each other, the number of the HSC signals counted by the horizontal synchronization counter 10 and the number of DE signals counted by the data-enable counter 20 increase in synchronization with each other.

Since the integer M is greater than the integer N (M>N) as mentioned earlier, the timing T15 at which the number of the DE signals counted by the data-enable counter 20 reaches the integer N, and thus, the DC-RC signal turns into a high level is earlier than the timing T16 at which the number of the HSC signals counted by the horizontal synchronization counter 10 reaches the integer M, and thus, the HC-RC signal turns into a high level.

Accordingly, the RCOR signal transmitted from the OR circuit 30 turns to a high level from a low level at the same timing as a timing at which the DC-RC signal transmitted from the data-enable counter 20 is turned into a high level from a low level, that is, at the timing T15.

Since the number of the DE signals counted by the data-enable counter 20 is N at the timing T15 at which the RCOR signal rises up, the signal DES transmitted from the judge unit 40 turns to a low level at the timing T15. Accordingly, the mode-selecting circuit 100 selects the DE mode.

Figure 7:
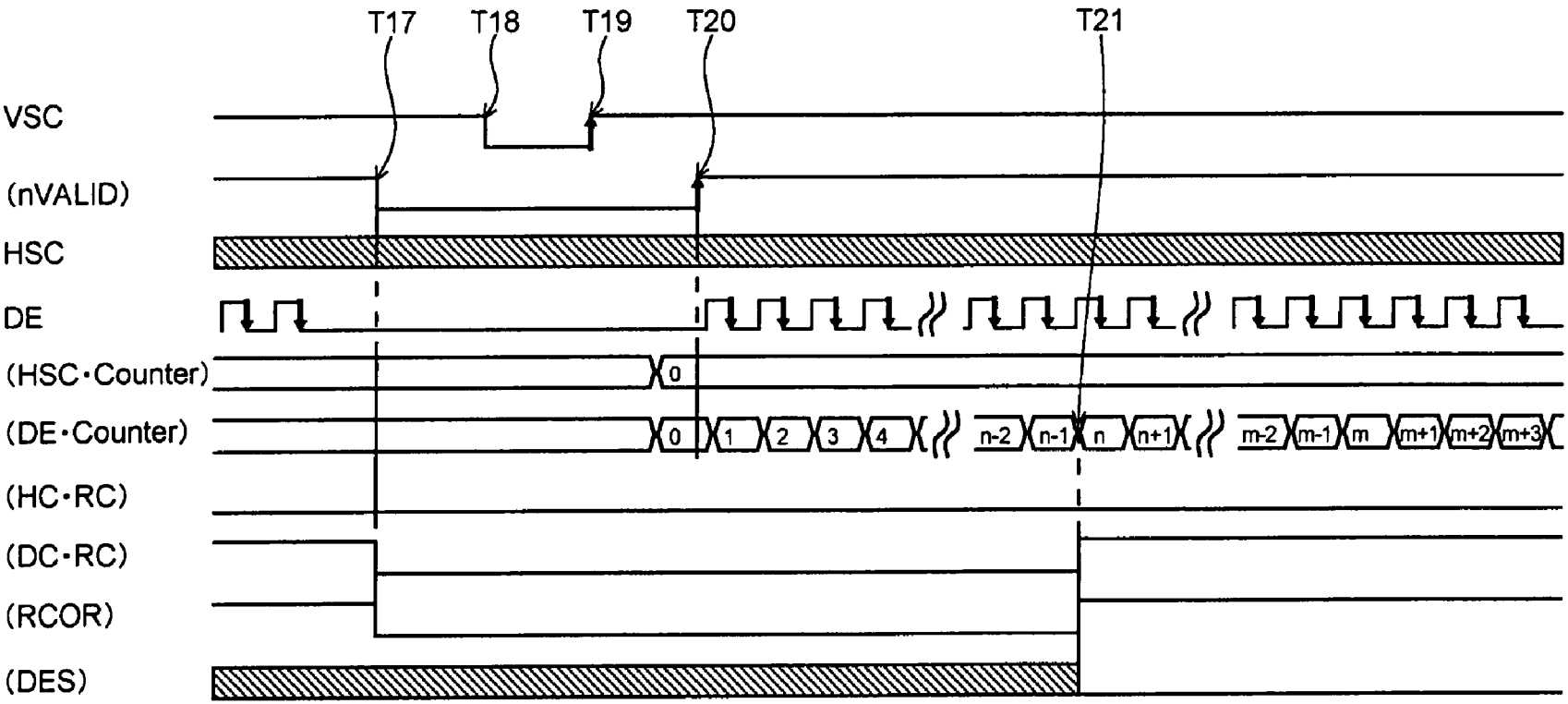
FIG. 7 is a timing chart showing an operation of the mode-selecting apparatus illustrated in FIG. 2.

FIG. 7 is a timing chart showing an operation of the mode-selecting circuit 100 when the HSC signal is not input into the mode-selecting circuit 100, but the VSC and DE signals are input into the mode-selecting circuit 100.

The horizontal synchronization counter 10 resets the HC-RC signal and the data-enable counter 20 resets the DC-RC signal, that is, the horizontal synchronization counter 10 switches the HC-RC signal to a low level from a high level and the data-enable counter 20 switches the DC-RC signal to a low level from a high level both at an earlier timing among timings at which the VSC and n-VALID signals fall down.

In the operation shown in FIG. 7, since the VSC and DE signals are both input into the mode-selecting circuit 100, the n-VALID signal is produced and input into the horizontal synchronization counter 10.

Thus, both of the VSC and n-VALID signals both defining a timing at which the HC-RC and DC-RC signals are reset are input into the horizontal synchronization counter 10 and the data-enable counter 20.

As shown in FIG. 7, since a timing T17 at which the n-VALID signal falls down is earlier than a timing T18 at which the VSC signal falls down, the HC-RC and DC-RC signals are reset, that is, switched to a low level from a high level by the horizontal synchronization counter 10 and the data-enable counter 20, respectively, at the timing T17 at which the VSC signal falls down.

In addition, in the operation shown in FIG. 7, since the HC-RC and DC-RC signals are reset at the timing T17, the RCOR signal transmitted from the OR circuit 30 is reset, that is, switched to a low level from a high level at the timing T17.

The number of the HSC signals counted by the horizontal synchronization counter 10 and the number of the DE signals counted by the data-enable counter 20 are reset at a timing at which the VSC and n-VALID signals rise up.

In the operation shown in FIG. 7, since the VSC and DE signals are input into the mode-selecting circuit 100, the n-VALID signal is produced, and input into the horizontal synchronization counter 10.

As shown in FIG. 7, since a timing T19 at which the VSC signal rises up is earlier than a timing T20 at which the n-VALID signal rises up, the number of the HSC signals counted by the horizontal synchronization counter 10 and the number of the DE signals counted by the data-enable counter 20 are reset into zero (0) at the timing T19 at which the VSC signal falls down, and then, reset again into zero (0) at the timing T20 at which the n-VALID signal rises up.

The data-enable counter 20 continues counting the DE signal during the timing T19 to the timing T20. However, the number of the DE signals counted by the data-enable counter 20 does not reach the integer N.

This is because the number of the DE signals counted during the timing T19 to the timing T20 must be smaller than the integer N, since the integer N is designed greater than a number of lines in a non-display period of the VSC signal.

On receipt of the DE signal, the data-enable counter 20 starts counting up at the timing T20, and produces a DC-RC signal which turns to a high level from a low level at a timing T21 at which the number of the DE signals counted by the data-enable counter 20 reaches the integer N. The thus produced DC-RC signal is output to the OR circuit 30.

In the operation shown in FIG. 7, since the HSC signal is not input into the mode-selecting circuit 100, the horizontal synchronization counter 10 does not count up, and hence, the number of the HSC signals counted by the horizontal synchronization counter 10 remains equal to zero (0). Hence, the HC-RC signal remains in a low level.

The RCOR signal transmitted from the OR circuit 30 turns to a high level from a low level at the same timing as a timing at which the DC-RC signal transmitted from the data-enable counter 20 is turned into a high level from a low level, that is, at the timing T21.

Since the number of the DE signals counted by the data-enable counter 20 is N at the timing T21 at which the RCOR signal rises up, the signal DES transmitted from the judge unit 40 turns to a low level at the timing T21. Accordingly, the mode-selecting circuit 100 selects the DE mode.

In accordance with the above-mentioned embodiments, it is possible to accurately select the fixed mode or the DE mode in all of the input/non-input combinations of the VSC, HSC and DE signals, that is, the five combinations having been explained with reference to FIGS. 3 to 7.

Furthermore, since a counter which can count a number greater than the integer M can be used as the horizontal synchronization counter 10, and a counter which can count a number greater than the integer N can be used as the data-enable counter 20, a circuit size of the counters 10 and 20 can be reduced relative to a circuit size of the counter suggested in Japanese Patent Application Publication No. 10-148812.

As the display apparatus in accordance with the present invention, the liquid crystal display device 200 is explained as an example in the above-mentioned embodiment. However, it should be noted that the present invention can be applied any display apparatus other than a liquid crystal display device.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2004-299172 filed on Oct. 13, 2004 including specification, claims, drawings and summary is incorporated herein by reference in its entirety.

What is claimed is:

1. A mode-selecting apparatus for selecting one of a first mode in which images are displayed on a display unit in accordance with a vertical synchronization control signal and a horizontal synchronization control signal, and a second mode in which images are displayed on said display unit in accordance with a data-enable signal, including:

a first unit which counts a number of input horizontal synchronization control signals in each of frame periods;

a second unit which counts a number of input data-enable signals in each of frame periods; and a third unit which selects one of said first and second modes in accordance with both said number of input horizontal synchronization control signals and said number of input data-enable signals, wherein said first unit resets said number of input horizontal synchronization control signals, and said second unit resets said number of input data-enable signals, wherein said first unit detects a first timing at which said number of input horizontal synchronization control signals is equal to M wherein M indicates a predetermined positive integer, and said second unit detects a second timing at which said number of input data-enable signals is equal to N wherein N indicates a predetermined positive integer smaller than said M, and wherein said third unit selects said first mode if said number of input data-enable signals is equal to zero (0) at an earlier timing among said first and second timings, and selects said second mode if said number of input data-enable signals is not equal to zero (0) at an earlier timing among said first and second timings.

2. The mode-selecting apparatus as set forth in claim 1, wherein said first unit produces a first target-arrival signal at said first timing, and said second unit produces a second target-arrival signal at said second timing, and further including a fourth unit which produces a logical-sum signal at a timing at which at least one of said first and second target-arrival signal is produced, and wherein said third unit selects said first mode if said number of input data-enable signals is equal to zero (0) at a timing at which said logical-sum signal is produced, and selects said second mode if said number of input data-enable signals is not equal to zero (0) at a timing at which said logical-sum signal is produced.

3. The mode-selecting apparatus as set forth in claim 2, wherein said first unit resets said first target-arrival signal, and said second unit resets said second target-arrival signal.

4. The mode-selecting apparatus as set forth in claim 3, wherein said first unit resets said first target-arrival signal at a timing at which each of frame periods ends, and said second unit resets said second target-arrival signal at a timing at which each of frame periods ends.

5. The mode-selecting apparatus as set forth in claim 4, wherein said timing is defined by one of a second signal having a frame period and produced in accordance with said data-enable signals, and said vertical synchronization control signals.

6. The mode-selecting apparatus as set forth in claim 5, wherein said timing is an earlier timing among a timing at which said second signal falls down, and a timing at which said vertical synchronization control signal falls down.

7. The mode-selecting apparatus as set forth in claim 1, wherein said N is greater than a maximum number of said horizontal synchronization control signals which can be input thereinto in a non-display period in each of frame periods.

8. A mode-selecting apparatus for selecting one of a first mode in which images are displayed on a display unit in accordance with a vertical synchronization control signal and a horizontal synchronization control signal, and a second mode in which images are displayed on said display unit in accordance with a data-enable signal, including:

a first unit which counts a number of input horizontal synchronization control signals, and resets said number of input horizontal synchronization control signals;

a second unit which counts a number of input data-enable signals, and resets said number of input data-enable signals; and a third unit which selects one of said first and second modes in accordance with both said number of input horizontal synchronization control signals and said number of input data-enable signals, wherein said first unit detects a first timing at which said number of input horizontal synchronization control signals is equal to M wherein M indicates a predetermined positive integer, and said second unit detects a second timing at which said number of input data-enable signals is equal to N wherein N indicates a predetermined positive integer smaller than said M, and wherein said third unit selects said first mode if said number of input data-enable signals is equal to zero (0) at an earlier timing among said first and second timings, and selects said second mode if said number of input data-enable signals is not equal to zero (0) at an earlier timing among said first and second timings.

9. The mode-selecting apparatus as set forth in claim 8, wherein said first unit produces a first target-arrival signal at said first timing, and said second unit produces a second target-arrival signal at said second timing, and further including a fourth unit which produces a logical-sum signal at a timing at which at least one of said first and second target-arrival signal is produced, and wherein said third unit selects said first mode if said number of input data-enable signals is equal to zero (0) at a timing at which said logical-sum signal is produced, and selects said second mode if said number of input data-enable signals is not equal to zero (0) at a timing at which said logical-sum signal is produced.

10. The mode-selecting apparatus as set forth in claim 9, wherein said first unit resets said first target-arrival signal, and said second unit resets said second target-arrival signal.

11. The mode-selecting apparatus as set forth in claim 10, wherein said first unit resets said first target-arrival signal at a timing at which each of frame periods ends, and said second unit resets said second target-arrival signal at a timing at which each of frame periods ends.

12. The mode-selecting apparatus as set forth in claim 11, wherein said timing is defined by one of a second signal having a frame period and produced in accordance with said data-enable signals, and said vertical synchronization control signals.

13. The mode-selecting apparatus as set forth in claim 12, wherein said timing is an earlier timing among a timing at which said second signal falls down, and a timing at which said vertical synchronization control signal falls down.

14. The mode-selecting apparatus as set forth in claim 8, wherein said N is greater than a maximum number of said horizontal synchronization control signals which can be input thereinto in a non-display period in each of frame periods.

15. A mode-selecting apparatus for selecting one of a first mode in which images are displayed on a display unit in accordance with a vertical synchronization control signal and a horizontal synchronization control signal, and a second mode in which images are displayed on said display unit in accordance with a data-enable signal, including:

a first unit which (a) counts a number of input horizontal synchronization control signals, (b) resets said number of input horizontal synchronization control signals at each of a timing at which a n-VALID signal having a frame period and produced in accordance with said data-enable signal rises up, and a timing at which said vertical synchronization control signal rises up, (c) produces a HC-RC signal designed to be in a high level at a first timing at which said number of input horizontal synchronization control signals is equal to M wherein M indicates a predetermined positive integer, and (d) resets said HC-RC signal into a low level at an earlier timing among a timing at which said n-VALID signal falls down, and a timing at which said vertical synchronization control signal falls down;

a second unit which (a) counts a number of input data-enable signals, (b) resets said number of input data-enable signals at each of a timing at which a signal having a frame period and produced in accordance with said data-enable signal rises up, and a timing at which said vertical synchronization control signal rises up, (c) produces a DC-RC signal designed to be in a high level at a second timing at which said number of input data-enable signals is equal to N wherein N indicates a predetermined positive integer smaller than said M, and (d) resets said DC-RC signal into a low level at an earlier timing among a timing at which said n-VALID signal falls down, and a timing at which said vertical synchronization control signal falls down;

a third unit which selects one of said first and second modes; and a fourth unit which produces a logical-sum signal designed to be in a high level at a timing at which at least one of said HC-RC signal and said DC-RC signal is in a high level, said third unit selecting said first mode if said number of input data-enable signals is equal to zero (0) at a timing at which said logical-sum signal was produced, and selecting said second mode if said number of input data-enable signals is not equal to zero (0) at said timing.

16. The mode-selecting apparatus as set forth in claim 15, wherein said N is greater than a maximum number of said horizontal synchronization control signals which can be input thereinto in a non-display period in each of frame periods.

17. The mode-selecting apparatus as set forth in claim 15, wherein said first and second units re-count said number of input horizontal synchronization control signals and said number of said input data-enable signals, starting from zero (0), after said number of input horizontal synchronization control signals and said number of said input data-enable signals reached maximum numbers countable by said first and second units.

18. A display apparatus including:

a display unit; and a mode-selecting apparatus for selecting one of a first mode in which images are displayed on said display unit in accordance with a vertical synchronization control signal and a horizontal synchronization control signal, and a second mode in which images are displayed on said display unit in accordance with a data-enable signal, including:

a first unit which (a) counts a number of input horizontal synchronization control signals, (b) resets said number of input horizontal synchronization control signals at each of a timing at which a n-VALID signal having a frame period and produced in accordance with said data-enable signal rises up, and a timing at which said vertical synchronization control signal rises up, (c) produces a HC-RC signal designed to be in a high level at a first timing at which said number of input horizontal synchronization control signals is equal to M wherein M indicates a predetermined positive integer, and (d) resets said HC-RC signal into a low level at an earlier timing among a timing at which said n-VALID signal falls down, and a timing at which said vertical synchronization control signal falls down;

a second unit which (a) counts a number of input data-enable signals, (b) resets said number of input data-enable signals at each of a timing at which a signal having a frame period and produced in accordance with said data-enable signal rises up, and a timing at which said vertical synchronization control signal rises up, (c) produces a DC-RC signal designed to be in a high level at a second timing at which said number of input data-enable signals is equal to N wherein N indicates a predetermined positive integer smaller than said M, and (d) resets said DC-RC signal into a low level at an earlier timing among a timing at which said n-VALID signal falls down, and a timing at which said vertical synchronization control signal falls down;

a third unit which selects one of said first and second modes; and a fourth unit which produces a logical-sum signal designed to be in a high level at a timing at which at least one of said HC-RC signal and said DC-RC signal is in a high level, said third unit selecting said first mode if said number of input data-enable signals is equal to zero (0) at a timing at which said logical-sum signal was produced, and selecting said second mode if said number of input data-enable signals is not equal to zero (0) at said timing.

19. The display apparatus as set forth in claim 18, wherein said display apparatus is comprised of a liquid crystal display unit including a liquid crystal display panel as said display unit.

20. A method of selecting one of a first mode in which images are displayed on a display unit in accordance with a vertical synchronization control signal and a horizontal synchronization control signal, and a second mode in which images are displayed on said display unit in accordance with a data-enable signal, including:

counting a number of input horizontal synchronization control signals in each of frame periods;

counting a number of input data-enable signals in each of frame periods;

selecting one of said first and second modes in accordance with both said number of input horizontal synchronization control signals and said number of input data-enable signals, detecting a first timing at which said number of input horizontal synchronization control signals is equal to M wherein M indicates a predetermined positive integer;

detecting a second timing at which said number of input data-enable signals is equal to N wherein N indicates a predetermined positive integer smaller than said M; and selecting either said first mode if said number of input data-enable signals is equal to zero (0) at an earlier timing among said first and second timings, or said second mode if said number of input data-enable signals is not equal to zero (0) at an earlier timing among said first and second timings.

21. The method as set forth in claim 20, further including producing a first target-arrival signal at said first timing, producing a second target-arrival signal at said second timing, producing a logical-sum signal at a timing at which at least one of said first and second target-arrival signal is produced, selecting either said first mode if said number of input data-enable signals is equal to zero (0) at a timing at which said logical-sum signal is produced, or said second mode if said number of input data-enable signals is not equal to zero (0) at a timing at which said logical-sum signal is produced.

22. The method as set forth in claim 21, further including resetting said first target-arrival signal at a timing at which each of frame periods ends, and resetting said second target-arrival signal at a timing at which each of frame periods ends.

23. A method of selecting one of a first mode in which images are displayed on a display unit in accordance with a vertical synchronization control signal and a horizontal synchronization control signal, and a second mode in which images are displayed on said display unit in accordance with a data-enable signal, including:

counting a number of input horizontal synchronization control signals;

counting a number of input data-enable signals;

resetting said number of input horizontal synchronization control signals;

resetting said number of input data-enable signals;

selecting one of said first and second modes in accordance with both said number of input horizontal synchronization control signals and said number of input data-enable signals;

detecting a first timing at which said number of input horizontal synchronization control signals is equal to M wherein M indicates a predetermined positive integer;

detecting a second timing at which said number of input data-enable signals is equal to N wherein N indicates a predetermined positive integer smaller than said M; and selecting either said first mode if said number of input data-enable signals is equal to zero (0) at an earlier timing among said first and second timings, or said second mode if said number of input data-enable signals is not equal to zero (0) at an earlier timing among said first and second timings.

24. The method as set forth in claim 23, further including producing a first target-arrival signal at said first timing, producing a second target-arrival signal at said second timing, producing a logical-sum signal at a timing at which at least one of said first and second target-arrival signal is produced, selecting either said first mode if said number of input data-enable signals is equal to zero (0) at a timing at which said logical-sum signal is produced, or said second mode if said number of input data-enable signals is not equal to zero (0) at a timing at which said logical-sum signal is produced.

25. A method of selecting one of a first mode in which images are displayed on a display unit in accordance with a vertical synchronization control signal and a horizontal synchronization control signal, and a second mode in which images are displayed on said display unit in accordance with a data-enable signal, including:

counting a number of input horizontal synchronization control signals;

counting a number of input data-enable signals;

resetting said number of input horizontal synchronization control signals at each of a timing at which a n-VALID signal having a frame period and produced in accordance with said data-enable signal rises up, and a timing at which said vertical synchronization control signal rises up;

resetting said number of input data-enable signals at each of a timing at which a signal having a frame period and produced in accordance with said data-enable signal rises up, and a timing at which said vertical synchronization control signal rises up;

producing a HC-RC signal designed to be in a high level at a first timing at which said number of input horizontal synchronization control signals is equal to M wherein M indicates a predetermined positive integer;

producing a DC-RC signal designed to be in a high level at a second timing at which said number of input data-enable signals is equal to N wherein N indicates a predetermined positive integer smaller than said M;

producing a logical-sum signal designed to be in a high level at a timing at which at least one of said HC-RC signal and said DC-RC signal is in a high level;

resetting said HC-RC signal into a low level at an earlier timing among a timing at which said n-VALID signal falls down, and a timing at which said vertical synchronization control signal falls down;

resetting said DC-RC signal into a low level at an earlier timing among a timing at which said n-VALID signal falls down, and a timing at which said vertical synchronization control signal falls down; and selecting said first mode if said number of input data-enable signals is equal to zero (0) at a timing at which said logical-sum signal was produced, and selecting said second mode if said number of input data-enable signals is not equal to zero (0) at said timing.

* * * * *